US012601132B2

(12) United States Patent
Peirson et al.

(10) Patent No.: US 12,601,132 B2
(45) Date of Patent: Apr. 14, 2026

(54) FISH TRANSFER SYSTEM AND METHOD

(71) Applicant: TUBE FISHWAYS PTY. LTD., Sydney (AU)

(72) Inventors: William Leslie Peirson, New South Wales (AU); John Hamlyn Harris, Bootawa (AU); Stefan Markus Felder, Frenchs Forest (AU)

(73) Assignee: The University of New South Wales, Sydney (AU)

( * ) Notice: Subject to any disclaimer, the term of this patent is extended or adjusted under 35 U.S.C. 154(b) by 167 days.

(21) Appl. No.: 18/029,499

(22) PCT Filed: Sep. 30, 2021

(86) PCT No.: PCT/AU2021/051141
§ 371 (c)(1),
(2) Date: Mar. 30, 2023

(87) PCT Pub. No.: WO2022/067386
PCT Pub. Date: Apr. 7, 2022

(65) Prior Publication Data

US 2023/0358007 A1 Nov. 9, 2023

(30) Foreign Application Priority Data

Sep. 30, 2020 (AU) ..... 2020244510

(51) Int. Cl.
*E02B 8/08* (2006.01)

(52) U.S. Cl.
CPC ..... *E02B 8/085* (2013.01)

(58) Field of Classification Search
CPC ..... E02B 8/08; E02B 8/085
See application file for complete search history.

(56) References Cited

U.S. PATENT DOCUMENTS

| | | | | |
|---|---|---|---|---|
| 2,683,969 | A * | 7/1954 | Mugnier | E02B 8/085 405/83 |
| 9,359,737 | B2 * | 6/2016 | Seo | E02B 8/08 |
| 2019/0119874 | A1 * | 4/2019 | Aittaniemi | E02B 8/085 |
| 2020/0217032 | A1 | 7/2020 | Kalasydaen | |

FOREIGN PATENT DOCUMENTS

| | | | |
|---|---|---|---|
| CN | 111236181 | A | 6/2020 |
| WO | WO 2007/011274 | * | 1/2007 |

* cited by examiner

*Primary Examiner* — Sean D Andrish
(74) *Attorney, Agent, or Firm* — Shutts & Bowen LLP

(57) ABSTRACT

Disclosed is a system and method for transferring fish past a barrier between an upper and lower body of water, including an inlet conduit 11 connecting the upper body to a transfer chamber 13 adjacent the lower body, a delivery conduit 15 connecting the transfer chamber 13 to a level above the surface of the upper body, a valve 12 between the inlet conduit and the transfer chamber, and a gate 14 between the transfer chamber 13 and the lower body. The inlet conduit 11 holds sufficient water so that, once the gate 14 is closed and the valve 12 is opened, fish in the transfer chamber 13 are transported with the water in the transfer chamber through the delivery conduit 15 to an outlet 16.

15 Claims, 6 Drawing Sheets

FISH TRANSFER SYSTEM AND METHOD

CROSS-REFERENCE TO RELATED APPLICATION(S)

This application is National Stage of International Patent Application No. PCT/AU2021/051141, entitled FISH TRANSFER SYSTEM AND METHOD, filed on Sep. 30, 2021, which claims priority to Australian Application No. 2020244510, filed on Sep. 30, 2020, the disclosures of which are incorporated herein by reference in their entirety.

TECHNICAL FIELD

The present invention relates to the transfer of fish to facilitate migration across dams, weirs and similar structures.

BACKGROUND OF THE INVENTION

Freshwater fish populations are declining globally. A major factor in this decline is loss of connectivity in river systems due to dams and weirs. Most (possibly all) freshwater fish rely on river connectivity to migrate, spawn, feed and take refuge.

To restore connectivity in the presence of dam structures, a fishway is required. For high dam structures, development of reliable fishways has proved challenging. Many different structures have been proposed, for example fish elevators, fish ladders, other bypass systems, and trap and haul systems. These all commonly have significant drawbacks.

U.S. Pat. No. 8,011,854 to Millard discloses a fish passage apparatus, in which one or more connecting tubes are provided between two bodies of water. A working tube is connected vertically to the connecting tube. By selectively controlling valves, a column of water with potential energy is created in the connecting tube, and this column is used to generate a surge of water, higher than the upper water level, for discharge from the working tube. The working tube surge is used to generate electricity, using a generator. Whilst the disclosure teaches that this apparatus can be used as a fish migration system, it explicitly teaches that a screen must be provided to prevent the fish passing into the vertical working tube, as this is thought likely to be injurious to the fish.

It is an object of the present invention to provide a fish transport system which is effective in use to transport fish to facilitate migration.

SUMMARY OF THE INVENTION

In a first broad form, the present invention provides a fish transfer system in which a pressurised conduit is used to generate a head of potential energy, which is used to transfer fish from a transfer chamber at a lower level through an outlet at a higher level.

According to a first aspect, the present invention provides a system for transferring fish past a barrier between an upper and lower body of water, including an inlet conduit connecting the upper body to a transfer chamber adjacent the lower body, a delivery conduit connecting the transfer chamber to a level above the surface of the upper body, a valve between the inlet conduit and the transfer chamber, and a gate between the transfer chamber and the lower body, wherein the inlet conduit is dimensioned to hold sufficient water so that, once the gate is closed and the valve is opened, fish in the transfer chamber are transported with the water in the transfer chamber through the delivery conduit.

According to another aspect, the present invention provides a method for transferring fish past a barrier between an upper and lower body of water, wherein structures are provided including an inlet conduit connecting the upper body to a transfer chamber adjacent the lower body, a delivery conduit connecting the transfer chamber to a level above the surface of the upper body, a valve between the inlet conduit and the transfer chamber, and a gate between the transfer chamber and the lower body, the method including at least the steps of:

a) Closing the gate to seal the transfer chamber, b) Opening the valve to connect the inlet conduit to the transfer chamber, thereby transporting any fish in the transfer chamber with the water in the transfer chamber through the delivery conduit, and c) Discharging the fish into the upper body.

According to a further aspect, the present invention provides a method for modifying a barrier between an upper and lower body of water to provide a fish transfer system, including installing structures including an inlet conduit connecting the upper body to a transfer chamber adjacent the lower body, a delivery conduit connecting the transfer chamber to a level above the surface of the upper body, a valve between the inlet conduit and the transfer chamber, and a gate between the transfer chamber and the lower body, wherein the inlet conduit is dimensioned to hold sufficient water so that, once the gate is closed and the valve is opened, fish in the transfer chamber are transported with the water in the transfer chamber through the delivery conduit.

Implementations of the present invention accordingly provide an effective transfer mechanism for fish, which does not require external pumps, and uses the potential energy of a higher body of water to move fish from the lower level to the higher body. Relatively simple infrastructure is required, and relatively large height differences can be accommodated.

BRIEF DESCRIPTION OF THE DRAWINGS

An illustrative implementation of the present invention will be described with reference to the accompanying figures, in which.

DETAILED DESCRIPTION OF THE INVENTION

The present invention is applicable to barriers provided in rivers, canals or other bodies of water, for example dams, weirs and other impediments to the ability of fish to move or migrate past the barrier. The term dam will be used, to take a broad meaning as any barrier to fish movement.

Similarly, whilst the description and example below are primarily directed at fish moving upstream, the principles of the present invention can equally be applied to fish moving downstream, or across different braids or sections of a river or other waterway.

Conventionally, to transport liquid vertically in a conduit, a mechanical pump is used. However, this requires applying substantial pressures and shears to the fluid which may damage materials borne in the fluid. For delicate biota such as fish, the pressures and shears required by pumps to transport them vertically large distances pose a high risk of serious injury.

The pipes used are conventional. They must be designed to resist the applied pressures and forces. Smooth pipes are preferred for hydraulic efficiency and to minimise possible abrasion injury to fish. Circular cross-sectional pipes are shown here but other shapes could be used.

According to implementations of the present invention, a system is provided with simple components and minimal moving parts, which is capable of transporting fish over vertical distances of 100 m or more. Further, the transported volume of water and fish may be maintained at near atmospheric pressure.

Figure 1:
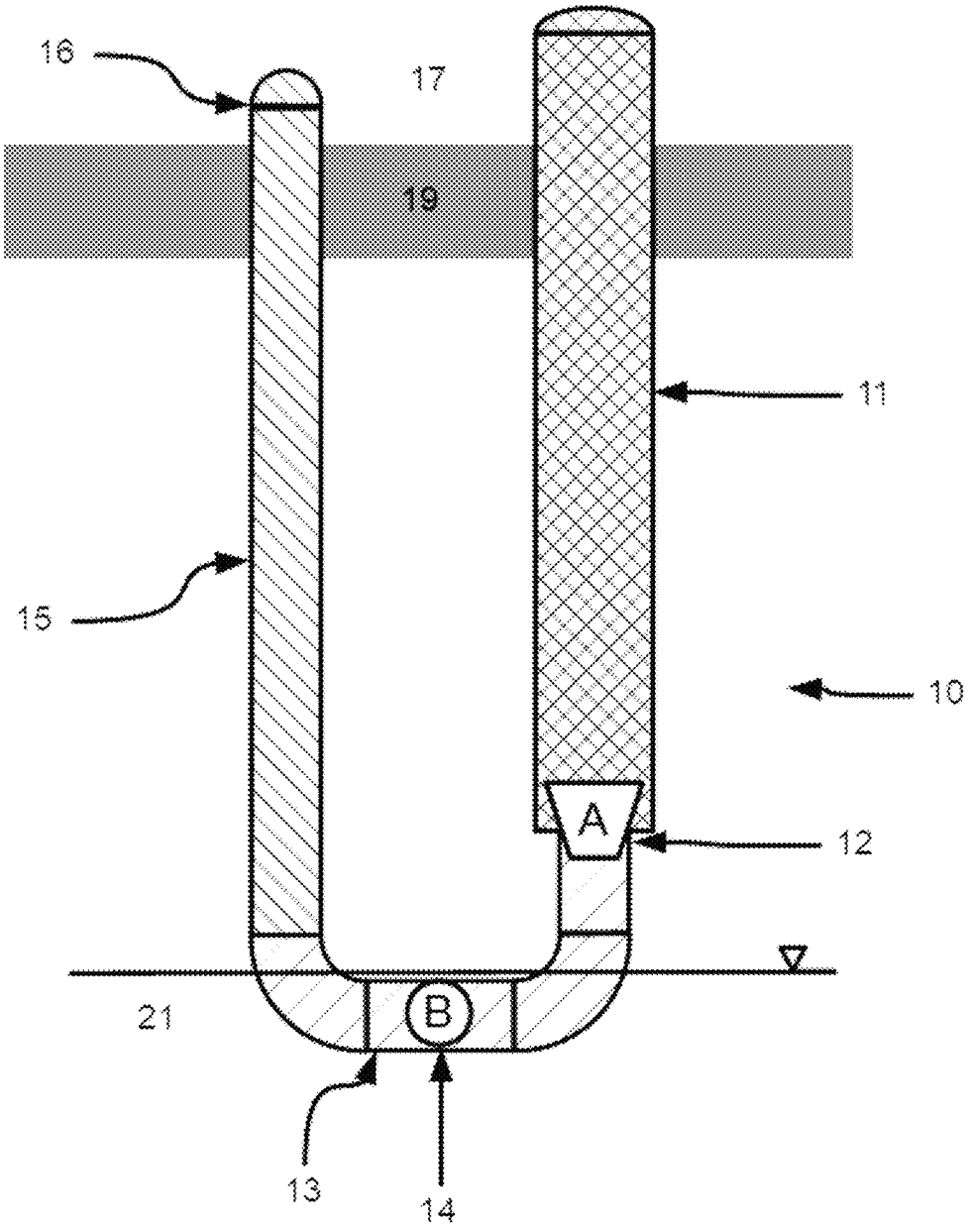
FIG. 1 is a schematic illustration of an implementation of the present invention.
Figure 2:
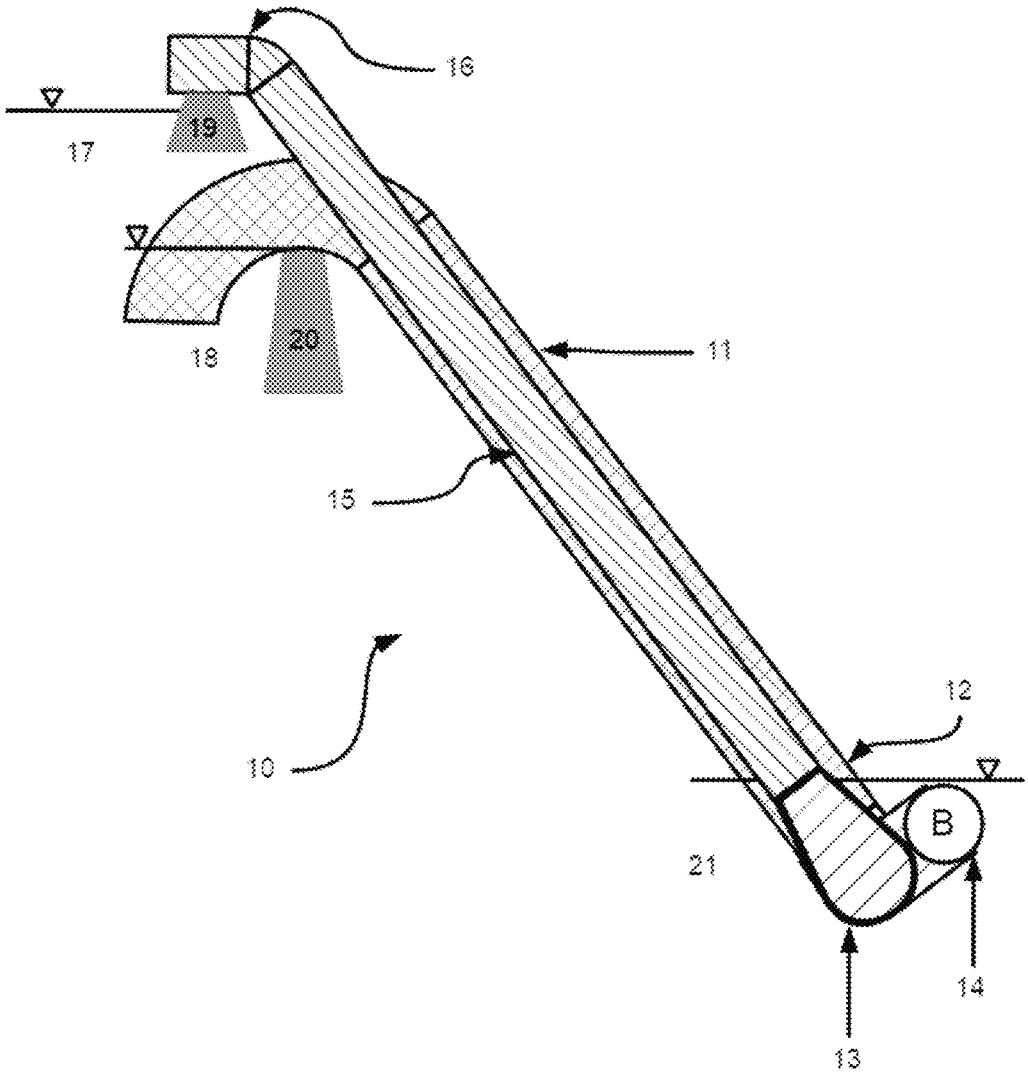
FIG. 2 is a side view of an implementation similar to FIG. 1, showing the key state variables and coordinate system, and in which the supply and delivery reservoir are at different levels.
Figure 3:
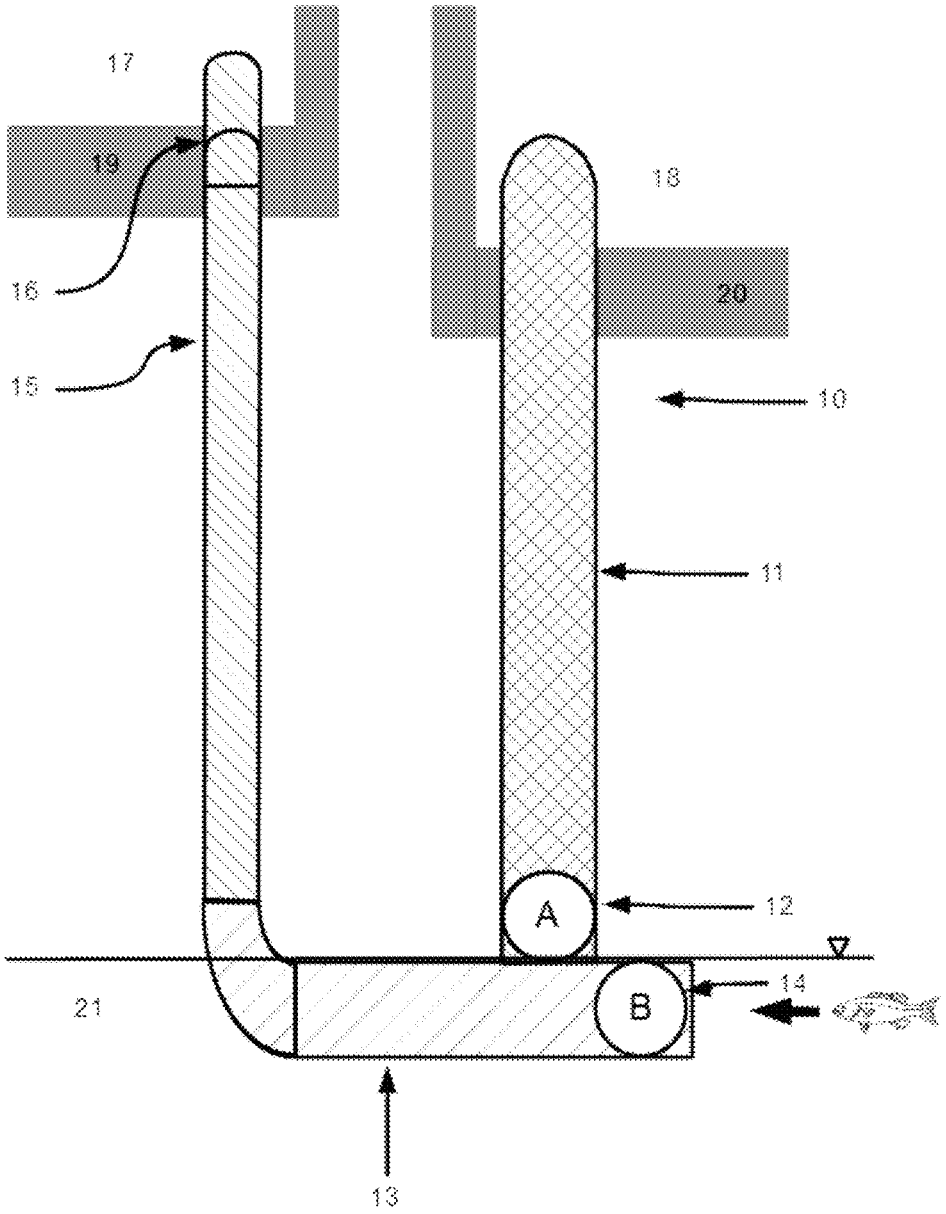
FIG. 3 is another view of the implementation of FIG. 2.

FIGS. 1 to 3 illustrate the components of basic implementations of the present invention. The system 10 includes an inlet conduit 11, a transfer chamber 13, valve A between inlet conduit 11 and transfer chamber 13. Gate B 14 separates transfer chamber 13 from the body of water at the foot of the dam.

Inlet conduit 11 is connected to the reservoir above, so that the column of water in inlet conduit extends to or near the height of the reservoir. For efficient transport of water over the dam, the diameter of inlet conduit 11 should be the same size or larger than delivery conduit 15.

Inlet conduit 11 can be pressurised by direct connection to the adjacent reservoir, as illustrated. In other implementations, the high point of the inlet conduit may be higher than or lower than the outlet reservoir, subject to the requirements for sufficient potential energy and other factors as discussed below. In some cases, a pump may be used to transfer water into the inlet conduit, particularly in the cases where the inlet conduit 11 is higher than the level of the body of water which is used to feed it.

In the implementation of FIGS. 2 and 3, the inlet reservoir and discharge reservoir are at different heights. It can be seen that the present invention encompasses such as arrangement, as well as where the inlet and discharge reservoir are at the same height.

Valve A is closed to allow the transfer chamber 13 to be depressurised. Once the fish have entered the transfer chamber via gate B 14, gate B 14 is then closed to seal transfer chamber 13 from the adjacent body of water. When valve A 12 is opened, pressure and flow are transferred from inlet conduit 11 to transfer chamber 13. Pressure from the inlet conduit 11 causes the contents of the transfer chamber, including any fish, to travel up the delivery conduit 15 to the outlet 16.

Gate B 14 is then opened only when Valve A 12 is closed to allow any fluid in the delivery conduit to drain from the system. When the system is drained and gate B is open, fish can be attracted into the transfer chamber.

A suitable sequence of operation for this implementation is as follows:

1. In its initial state, valve A 12 is closed, ensuring that neither flow nor pressure are transferred from the inlet conduit 11 to the transfer chamber 13.
2. Gate B 14 is opened, allowing any fluid in the delivery conduit 15 to be drained from the system via gate B 14.
3. With gate B 14 still open, material can be loaded into the transfer chamber 13 via the gate B orifice. In the case of the transport of migrating fish, a small flow might be applied to the delivery conduit to attract the fish through gate B towards the junction between the transfer chamber 13 and the delivery conduit 15.
4. Once the transfer chamber 13 is loaded, gate B 14 is closed to allow the transfer chamber 13 to be pressurised.
5. Valve A 12 commences opening, ideally immediately after gate B 14 is closed, causing the contents of the transfer chamber to surge up the delivery conduit. The potential energy of the water in the inlet conduit and entering from the reservoir upstream is converted into increasing kinetic and potential energy within the delivery conduit. As water surges up the delivery conduit, potential energy is regained but not sufficient to arrest the flow. An unsteady discharge occurs into the upstream reservoir during the peak of the surge. During this process, the pressures imposed on the original transfer chamber contents remain in proximity with atmospheric pressure. The rate of opening of valve A determines the rate at which fluid accelerates up the delivery conduit 15.
6. Subject to adequate pressure and flow being applied via the inlet conduit, fluid will continue to travel up the delivery conduit 15 to deliver a volume of fluid over the reservoir crest. This volume of fluid contains the volume initially contained in the transfer chamber at step 4.
7. The fluid level in the delivery conduit 15 will equilibrate according to the pressure and volume of fluid in the inlet conduit.
8. The delivery cycle is complete and system can be re-initiated at step 1 for transport of another volume of fluid from the transfer chamber to the reservoir.

The present invention is discussed, for convenience, on the basis that the inlet and delivery conduits are essentially vertical. In terms of the delivery conduit, in many situations, for example where it is installed to traverse a dam wall, the conduit will likely follow the shape of the exterior dam or abutment face, for example as shown in FIG. 2.

The inlet conduit, as illustrated, is connected to the upper reservoir, at a suitable height for the conduit to be filled from the reservoir. However, it could alternatively or additionally also be pressurised using a pump, or filled from a different reservoir. The important factor is that a sufficient amount of potential energy is stored in the inlet conduit so that, when the valves are appropriately controlled, the contents of the transfer chamber are transported through the delivery conduit and into the desired discharge reservoir.

Figure 4:
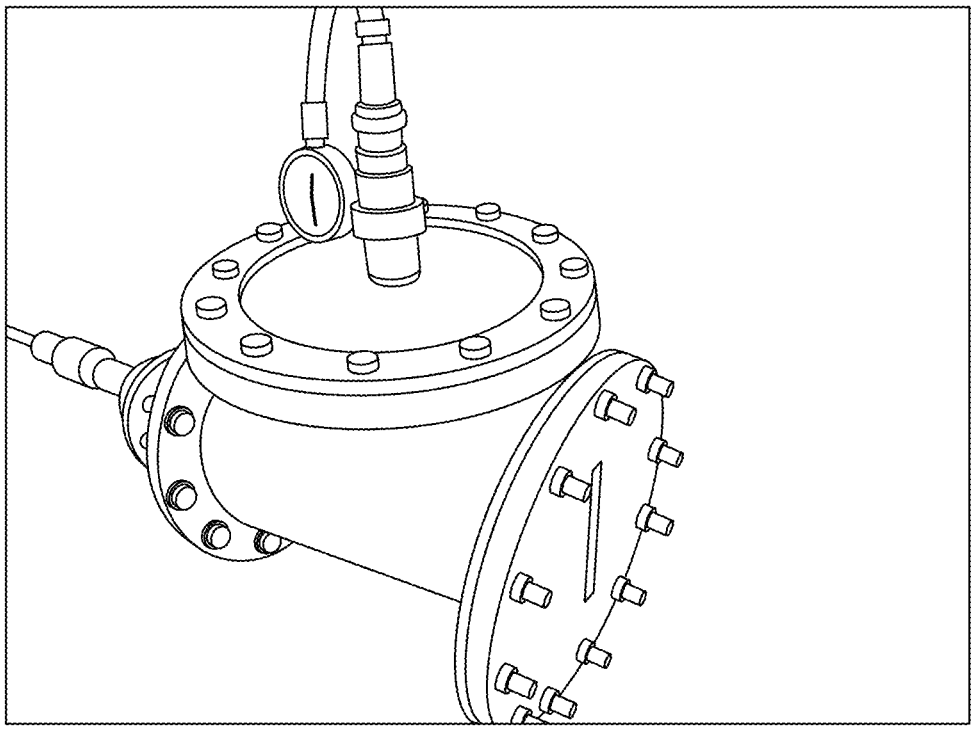
FIG. 4 is a photograph of an illustrative transfer chamber.

FIG. 4 shows an illustrative pump fishway transfer chamber which has been constructed and designed to withstand 50 m water pressure. The transfer chamber has been constructed in mild steel. It consists of a steel tee section with its flange bolted to an asymmetric contraction. The illustrated transfer chamber has been tested in excess of 510 kPa (more than 50 m $H_2O$).

In this photograph, at the front of FIG. 4 is shown the flange to which gate B is attached. Gate B in this example may conveniently consist of a hinged brass gate faced in rubber as well as providing a light source for fish attraction. The transparent window in the transfer chamber allows for inspection of the interior and the contained fish.

The behaviour of the entire system can be quantified using conventional pipe hydraulics incorporating an acceleration term applicable to each conduit (Streeter and Wylie, 1975 Eqn. 12.1.15; Finnemore and Franzini, 2002 § 12.3). Assuming incompressible flow, the continuity equation enables all motion state variables to be expressed in terms of the velocity in the delivery conduit and numerical integration can be used to determine the position of the delivery free surface (x).

A numerical model was developed using the configuration and characteristic dimensions shown in FIGS. 1 and 2. The entire system equation is:

$$Z_1 - K_{entry}\frac{|U_1|U_1}{2g} - \frac{f_1 Z_1}{D_1 \sin\theta}\frac{|U_1|U_1}{2g} - K_v\frac{|U_1|U_1}{2g} - \frac{\partial U_1}{\partial t}\frac{Z_1}{g\sin\theta} - K_{1-c}\frac{|U_c|U_c}{2g} - \frac{f_c L_c}{D_c}\frac{|U_c|U_c}{2g} - \frac{\partial U_c}{\partial t}\frac{L_c}{g} - K_{c-2}\frac{|U_2|U_2}{2g} - \frac{f_2 x}{D_2}\frac{|U_2|U_2}{2g} - \frac{\partial U_2}{\partial t}\frac{x}{g} = x.\sin\theta\left[+K_{exit}\frac{|U_2|U_2}{2g}\right] + \frac{|U_2|U_2}{2g} \quad (1)$$

where $Z_1$ is the water level in the upstream reservoir, x is the distance to the free surface along the delivery conduit, t is time referenced to the commencement of the opening of valve A, g is gravity and θ is the slope of the inlet and delivery conduits. The subscripts 1, C and 2 denote properties of the inlet conduit, transfer chamber and delivery conduit respectively.

Conduit properties are denoted as: U fluid mean velocity, f friction factor (determined from the Colebrook equation, Streeter and Wylie, 1975 Eqn. 5.10.7), L length and D diameter. Minor loss coefficients for the simulations presented here are all assumed conservatively to be unity as follows: $K_{entry}$, inlet entry; $K_v$, valve A; $K_{1-C}$ inlet-transfer bend; $K_{C-2}$ transfer-delivery bend; and, $K_{exit}$ exit bend. Note that x cannot exceed the length of the delivery conduit ($L_2=Z_2/\sin\theta$) and the exit bend loss (indicated by the square brackets in Equation 1) is not included when x is less than $L_2$.

For the development of design characterisations, the following assumptions regarding system geometry have been made:

1. The delivery conduit exits abruptly with a sharp bend.
2. During operation, the reservoir supplying the inlet conduit experiences no fluctuations in water level.
3. Fluid entry to the inlet conduit is to an abrupt protrusion followed by a gentle bend with negligible head loss associated with the bend and its length.
4. Apart from the entry and exit points, the inlet and delivery conduits are straight and their effective lengths can be determined directly from geometry and the specified reservoir/discharge levels. It will be appreciated that other options are possible in practical systems, but this is assumed for present purposes.
5. The assumed geometry of the transfer chamber is based on experience with fish behaviour and the development of the transfer chamber described in Harris et al. (2019). Here, it was assumed that $D_c/D_2=3$ and $L_c/D_c=2.5$. There is significant uncertainty in these estimates, only resolvable by field trials.

For the purposes of these calculations, we have selected a conduit size range from 0.1 to 1.0 m in diameter with vertical fish lift distances from 4 to 160 m. This range would accommodate most species of freshwater fish. The range of structure sizes reflect the size of dams of principal interest internationally for which passage cannot be easily provided by conventional means. Of course, accommodation for larger fish could be made in a suitable alternative implementation.

Using incompressible continuity, the system equation can be restated as $\partial U_2/\partial t$ as a function of x and $U_2$. Time integration was undertaken using Euler's or other Runge-Kutta methods method. The time step was systematically reduced until convergence was demonstrated. At the prototype scales considered here, Reynolds numbers varied from 0 at flow initiation up to values of approximately $10^6$.

One consideration for systems is the diameter ratios for the inlet and delivery conduits. Obviously, very small inlet conduits are subject to excessive pipe friction. Less obvious is how larger inlet sizes influence the system energy and maximum transfer volume.

There is an optimal ratio of inlet to delivery diameter of approximately 1.4 in terms of the volume V discharged by the system when the discharge elevation is one half delivery conduit diameter above the supply reservoir level. This ratio is insensitive to system scale for the range of practical sizes considered here.

Another consideration is the influence of upstream reservoir/discharge point elevation ratio. The volumes of water that can be lifted above the supply reservoir level will be described for an assumed ratio $D_1/D_2=1.2$. If $Z_1/Z_2$ is less than one, the volume discharged decreases rapidly as the ratio $Z_1/Z_2$ decreases. As shown, the volumes discharged assume a similar form when normalised by $$D_2^2 Z_1.$$

For $Z_1/Z_2<1$, there is a single initial surge during which discharge from the outlet occurs. Once the initial surge is complete, the computations show long-term and diminishing oscillations in water surface level within the delivery conduit. If the volume to be drained via gate B 14 was to be minimised during the remainder of the pumping cycle, suitable flow control could be implemented to arrest flow at the first oscillation trough.

For $Z_1/Z_2$ greater than 1, in addition to the initial surge, a steady flow from the upstream reservoir will develop. The total transfer volume will therefore be composed of two parts: the steady discharge and an initial unsteady discharge.

For $Z_1/Z_2>1$, computations proceeded until the rate of change in velocity in the delivery conduit had decreased to less than $10^{-8}$ g. The definition of return to steady flow is arbitrary but illustrates the relative contributions of the steady and unsteady components. Unsteady contribution was computed as the total discharge over the delivery conduit discharge period minus the steady discharge over the same duration.

The case where $Z_1$ is exactly equal to $Z_2$ is a special case. The steady discharge is zero. The system discharge is forced by the initial condition of the inlet conduit being filled with water and the delivery conduit being drained. A strong flow is initiated at the opening of valve A but attenuates due to hydraulic friction within the system.

Let us consider the volumetric (volume delivered/volume input per cycle) and energy efficiencies of an example of such a system can be quantified. Let us assume fish were to be lifted via a 1000 mm diameter delivery conduit over a dam with its design tailwater pool level 79.5 m below the dam crest and that a volume greater than the transfer chamber volume is to be delivered. In addition, it is assumed that at least a half diameter is required to pass the crest giving $Z_2/D_2=80$ and the inlet diameter is 1200 mm, $D_1/D_2=1.2$.

In this case a water level in a supply reservoir must be at least $Z_1/Z_2=0.975$ or $Z_1=78$ m above the tailwater pool. The volume delivered is $V/(D_2Z_2)=0.67$ or 53 $m^3$ and the volumetric efficiency is 46% and delivered within 30.5 s of the original valve opening. As the volume delivered has an elevation higher than the volume input, the energy efficiency of the present example is 47%.

Figure 5:
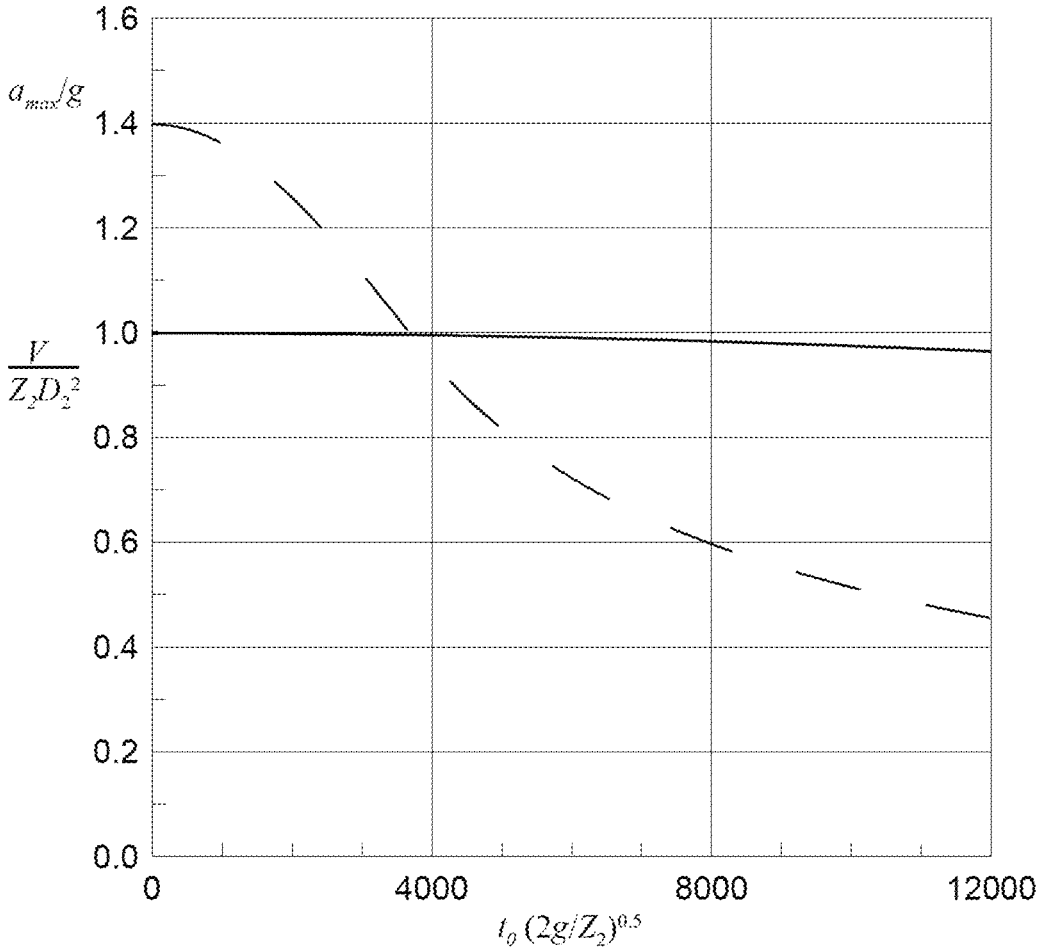
FIG. 5 is a graph showing the normalised maximum acceleration $a_{max}/g$ and normalised volume discharged V as a function of normalised valve opening time, for a specific implementation.

FIG. 5 is a graph of normalised maximum acceleration $a_{max}/g$ and normalised volume discharged V as a function of normalised valve opening time for $D_2=1.0$ m, $Z_2/D_2=40$, $D_1/D_2=1.2$ and $Z_2=Z_1+0.5D_2$. Inlet conduit lengths and delivery diameters are identical to those presented in FIG. 2. The solid line shows the normalised volume discharged and the long dashed line indicates the maximum acceleration normalised by gravity occurring within the delivery conduit during the transfer cycle.

If the residual volume in the delivery conduit could be drained through a turbomachine with an efficiency of 80% rather than via gate B, additional input energy can be extracted, without the fish being in any way in the path of a turbine or pump.

Implementations of the present invention may differ from many conventional fishways which rely on a continuous flow of water or a supply of energy to operate.

River structures differ in the slope of their downstream face and their adjacent abutments. Here the significance of accommodating sloping conduits is assessed. The frictional effects associated with non-vertical downstream structural faces are modest.

Without wishing to be bound by these calculations, we have determined that the discharge volume only changes negligibly if the alignment of the conduits changes from vertical to 70 degrees from horizontal. Even for conduit slopes less than 40 degrees, the normalised discharge will still exceed 75% of that of a vertical system.

Predicting all of the potential biological complexities of this system is beyond the scope of the present application. Harris et al. (2016) highlights some possible issues that are generic to most fishway systems. It is desirable in practical implementations of the present invention that it be able to transport multiple fish in a single pump sequence, including fish of different species and levels of maturity. In terms of positioning, the present evidence is that proximity of fishways to the structure is critical (Bunt, 2001). In terms of flow, there is a critical tension between the requirement of sufficient flow through the fishway to attract fish while avoiding velocities that will prevent fish approach. It is emphasised that while effective fish attraction is a feature of any practical system, the present invention may be implemented with any suitable fish attraction system.

For example, work by Mallen-Cooper (1992) has demonstrated that flow velocities must be less than 1 $ms^{-1}$ for passage of 95% of migrating juvenile Australian Bass. For juvenile barramundi, he also showed that passage requires velocities less than 0.66 $ms^{-1}$.

Any difference in diameter between the inlet transfer chamber and the delivery conduits creates the potential for localised fluid convective accelerations that are much greater than gravity. This could be damaging for transported animals. To our knowledge, there has been no investigation to date of the impacts of accelerations on fish.

Peak accelerations occur at initial opening of valve A 12. These can be reduced by extending the duration of the valve opening. Assuming a valve loss coefficient that reduces linearly from initiation to its open value at time $t_0$, the peak acceleration experienced reduces rapidly by increasing $t_0$. This change in initial motion has a very modest impact on the transfer volume.

It is highly desirable to maintain the transfer chamber contents at approximately atmospheric pressure. This means that fish must remain in proximity to the vertically-moving free surface interface during delivery. Assuming that fish behave as passive tracers, the effects of turbulent dispersion using conventional theory, (e.g. Fischer et al., 1979, Eqns. 2.26 and 4.40) in terms of spreading fish along the delivery conduit can be assessed. For mean values of the computed delivery conduit friction factor and transit times of the transfer chamber volume total turbulent dispersion during transport through the delivery conduit is estimated to only spread the fish over a conduit length 10% greater than that equivalent to their initial distribution within the transfer chamber. Fish do not, in general, behave as passive tracers. More detailed analyses can incorporate distributions of swim velocities that includes the effects of reverse swimming.

One concern with implementations of the present invention is whether damage to fish due to strong fluid shear or intense turbulence is possible (Hecker and Cook, 2005). Consequently, it is important that smooth entry of flow from the inlet conduit to the transfer chamber be achieved to avoid any strongly separated flow regions where fish may remain trapped in the transfer chamber or where they might be injured by the flow conditions.

During delivery, turbulence generated at the conduit's walls may potentially damage fish. In one relevant reported study of measurements of the turbulence tolerance levels of fish, Odeh et al. (2002) report minor injury to American juvenile fish when exposed to a fluid shear stress of 50 Pa for a period exceeding 10 minutes. However, "startle" response was observed to decrease when the shear stress exceeded 30 Pa.

For some implementations of the present invention, fish could be exposed to wall shear stresses significantly in excess of these thresholds while transiting the delivery conduit.

FIG. 5 illustrates the normalised maximum acceleration $a_{max}/g$ and normalised volume discharged V as a function of normalised valve opening time for $D_2=1.0$ m, $Z_2/D_2=40$, $D_1/D_2=1.2$ and $Z_2=Z_1+0.5D_2$. Inlet conduit lengths and delivery diameters are identical to those presented in FIG. 2. The solid line shows the normalised volume discharged and the long dashed line indicates the maximum acceleration normalised by gravity occurring within the delivery conduit during the transfer cycle.

By controlling valve A during operation, delivery conduit wall stresses in excess of a nominated threshold (assumed here to be 40 Pa) can be avoided. A defined critical turbulent shear stress in a pipe can be converted to a critical velocity $U_{crit,2}$ in the delivery conduit by assuming steady fully rough flow and Darcy friction. By continuity, the behaviour of a valve controlled to prevent velocities exceeding a critical value in the inlet conduit $U_{crit,1}$ can be defined as:

$$K_v = K_{v0}\left(\frac{U_{crit,1}}{U_{crit,1} - U_1}\right)^{\alpha} \tag{2}$$

where $K_{v0}$ is valve loss coefficient when fully open, $U_1$ is the instantaneous mean velocity in the inlet conduit and $\alpha$ is an exponent, here assumed to be 1.

For smaller heights of fish lift (4 m lift with a 0.1 m diameter delivery conduit), the fish transfer system performance and delivery times remain largely unchanged. At greater heights of fish lift, the dissipation of energy by the controlled valve significantly reduces the volume of water lifted. This greater resistance to fluid movement makes the movement of the vertical surge more sluggish ($Z_1/Z_2<1$) but also damps the unsteady motion when the supply reservoir is higher than the delivery reservoir ($Z_1/Z_2<1$).

A wall stress of 40 Pa may be conservative as the fluid stress decreases linearly away from the wall to zero at the pipe centreline. Hecker and Cook (2005) indicate that high fluid stresses at walls may not be injurious to fish.

It will be understood that although the preferred arrangement is to simply use an inlet conduit connected to the reservoir to develop the necessary potential energy in the inlet conduit, in suitable implementations a pump could be used in addition to store more energy in the inlet conduit.

It will be further understood that while the discussion above assumes conventional, constant cross section pipes are used for the inlet conduit and delivery conduit, in suitable applications the conduits could have variable cross section and a different shape. However, it will be appreciated that this is not preferred. Similarly, the inlet conduit could have energy stored as, for example, a wider section near the top, in order to increase the stored energy.

It will be understood that the internal structure of the conduits, the transfer chamber and their connections should to be smooth to avoid injury to transported animals. Implementations require only two moving solid components: the valve and the gate.

The transfer chamber should include a way to attract fish into the transfer chamber, and a gate which can be closed to seal the transfer chamber so that the system can operate to transport the fish.

An important design consideration is that the fish are attracted into a pipe of similar diameter. A transfer chamber of much larger diameter may not flush efficiently with the onset of flow. This increases the risk of fish being left in the transfer chamber during the lifting process. It is not generally desirable to use a much smaller pipe just for the transfer chamber due to the hydraulic inefficiencies of such systems. Harris et al. (2019) demonstrate suitable flow arrangements for attracting fish into a transfer chamber.

A smooth transition between transfer chamber and delivery pipe would be desirable to avoid fish injury. For example, curved 90 degree bends from the inlet pipe to transfer chamber have proved effective.

Alternative implementations are possible, in which an additional separate chamber is used to attract fish, and those fish are then moved to the transfer chamber. In this case, a more complex series of valves is required to separately open the additional chamber to the transfer tube, and then close off the additional chamber from the transfer chamber prior to the transfer operation.

The illustrated arrangement, using essentially only a single valve and gate to permit entry and facilitate transfer, has the benefit of simplicity, a reduced component count, and ease of construction and assembly. This may be particularly advantageous in a retro-fitting application.

Gate B allows fish entry to the transfer chamber, and closes to prevent the fish from escaping, and to enable the transfer chamber to be pressurised. In one form, this may be a simple plate hinged at its upper edge, faced in rubber to seal and lifted to an open position by an external actuator. For example, the following commercially available valve structure provides one alternative: https://www.valvesonline.com.au/wafer-swing-check-valve.

Valve A may be of any suitable type. For example a suitable device is an air actuated butterfly valve, see for example https://www.valvesonline.com.au/lugged-cast-iron-spring-return-butterfly-valve.

Speed of actuation and minimum turbulence generation (valve loss) is important for valve A. Possible alternative valve types include gate (https://www.valvesonline.com.au/cast-iron-double-acting-knife-gate-valve), suitably actuated ball (https://www.valvesonline.com.au/cast-steel-electric-ansi-150-flanged-fire-safe-bal), or possibly solenoids (https://www.valvesonline.com.au./cast-iron-normally-closed-solenoid-valve).

The valves may, in one implementation, be operated manually once fish are in the transfer chamber. In alternative implementations, a fish sensor may be used, so that the gate to the transfer chamber can be closed after a suitable time delay, and the valves then operated on a manual cycle or an automatic cycle. In another implementation, a timer operates so that, for example, every 15 minutes a transfer cycle is initiated. The latter approach would avoid issues of, for example, high turbidity after a flood event, which may be an important time for fish to migrate.

Figure 6:
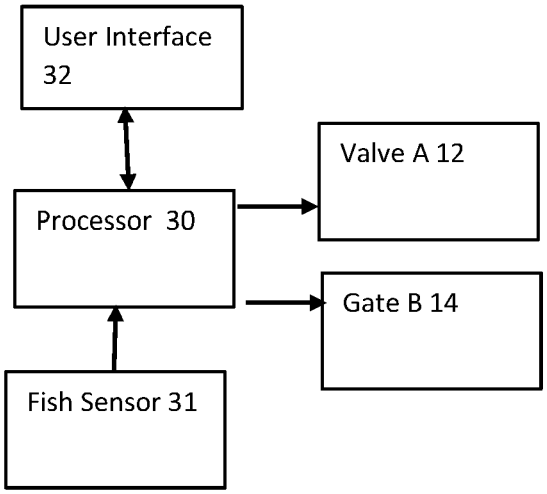
FIG. 6 is a block diagram of an electrical control system for an implementation of the present invention.

FIG. 6 illustrates a simple electrical control arrangement for this implementation of the present invention. Processor 30, for example a simple PLC (programmable logic controller) interacts with user interface 32, in order to receive instructions and provide logs and confirmation of status. A suitable industrial processing device with integrated memory may simply communicate via wifi, Bluetooth or the internet with a remote personal computer, acting as the user interface 32.

In this implementation, the valve 12 and gate 14 are electrically controlled and hardwired to the PLC. If required, controlled solenoid or similar arrangements may allow for control of the higher power requirements of the valves. In other implementations, a network-based control bus may be used. It will be appreciated that these are all conventional, commercially available components. Power for operation of the valve and gate could be provided by pneumatic, hydraulic or electrical systems. Of course, manually operated components could also be used.

Processor, responsive to the fish sensor 31 (for example a photoelectric device) is programmed to control valve A and gate 14, for example in the sequence outlined above. The fish sensor is optional; the system could simple cycle at fixed intervals, as discussed above.

The upstream storage could be used to drive hydroelectrics to create electrical energy, so as to power the system without the need for external power. Other possible alternatives could use the flow of water to provide timing for valve actuation, or the water pressure to actuate the valves. However, the simplest arrangement for automated control would be conventional microprocessor controls for the valves.

In practical systems, an attraction flow is provided via the open gate on the transfer chamber to attract fish. In trials, this has proved effective to lure fish into the transfer chamber within a short time of exposure. The gate is then closed. In trials, fish of different species have been reliably delivered from the transfer chamber to the outlet of the delivery conduit.

The following symbols are used in this description:

$a_{max}$=maximum acceleration of the delivery conduit free surface [$ms^{-2}$]

D=Diameter [m];

$D_c$=Diameter of transfer chamber [m];
$D_1$=Diameter of inlet conduit [m];
$D_2$=Diameter of delivery conduit [m];
$f_c$=Friction coefficient in transfer chamber [ ];
$f_1$=Friction coefficient in the inlet conduit [ ];
$f_2$=Friction coefficient in the delivery conduit [ ];
g=gravitational acceleration [$ms^{-2}$];
$K_{entry}$=Entry loss coefficient [ ];
$K_v$=Loss coefficient of valve A [ ];
$K_{v0}$=Loss coefficient of valve A when fully open
$K_{1-c}$=Bend loss coefficient from inlet conduit to transfer chamber [ ];
$K_{c-2}$=Bend loss coefficient from transfer chamber to delivery conduit [ ];
$K_{exit}$=Exit loss coefficient [ ];
L=length [m];
$L_c$=Length of the transfer chamber [m];
$L_2$=Length of the delivery conduit [m];
t=time [s];
$t_v$=time for volume delivery [s];
$t_0$=the time for valve A to move from fully closed to fully opening [s];
$U_c$=Velocity in the transfer chamber [$ms^{-1}$];
$U_{crit,1}$=critical velocity in the inlet conduit [$ms^{-1}$];
$U_{crit,2}$=critical velocity in the outlet conduit [$ms^{-1}$];
$U_1$=Velocity in the inlet conduit [$ms^{-1}$];
$U_2$=Velocity in the delivery conduit [$ms^{-1}$];
x=position of the free surface in the delivery conduit [m];
$x_0$=initial position of the free surface in the delivery conduit [m];
V=Volume delivered on each cycle [$m^3$];
$Z_1$=Elevation of water in upstream reservoir [m];
$Z_2$=System delivery elevation [m];
θ=Inlet and delivery conduit slope [ ];

BIBLIOGRAPHY

Bunt, C. M. (2001), Fishway entrance modifications enhance fish attraction. *Fisheries Management and Ecology,* 8: 95-105. doi:10.1046/j.1365-2400.2001.00238.x Fischer, H., List, J., Koh, C., Imberger, J. and Brooks, N. (1979) *Mixing in Inland and Coastal Waters.* 1st Ed. Academic Press ISBN: 9780122581502

Finnemore, E. J. and Franzini, J. B. (2002) *Fluid mechanics with engineering applications.* 10th Ed. McGraw-Hill. ISBN 978-0-07-243202-2

Harris, J. H., Kingsford, R. T., Peirson, W. L. & Baumgartner, L. J. (2016). Mitigating the effects of barriers to freshwater fish migrations: the Australian experience. *Marine and Freshwater Research* http://dx.doi.org/10.1071/MF15284

Harris J H, Peirson W L, Mefford B, Kingsford R T and Felder S. (2019). Laboratory testing of an innovative tube fishway concept. *Journal of Ecohydraulics* Volume 5, 2020(1), 84-93.

Hecker, G. E. and Cook, T. C. (2005) Development and Evaluation of a New Helical Fish-Friendly Hydroturbine. *J. Hydr. Eng. ASCE.* 10.1061/(ASCE)0733-9429(2005) 131:10(835)

Mallen-Cooper M. (1992) Swimming ability of juvenile Australian bass, *Macquarie novemaculeata* (Steindachner), and juvenile barramundi, *Lates calcarifer* (Bloch), in an experimental vertical-slot fishway. *Aust. J. Marine Freshwater Res.* 43, 823-834.

Odeh, M., Noreika, J. F., Haro, A., Maynard, A., Castro-Santos, T., and Cada, G. F. (2002) Evaluation Of The Effects Of Turbulence On The Behavior Of Migratory Fish. Report prepared for the U.S. Department of Energy, Bonneville Power Administration, Portland. Project Number 2000-057-00. Contract Number 00 AI 428 26531. March Streeter, V. L. and Wylie, E. B. (1975) *Fluid Mechanics.* 5th Edition. McGraw-Hill. ISBN: 0-451 07-062193-4

The invention claimed is:

1. A system for transferring fish past a barrier between an upper body and a lower body of water, including an inlet conduit connecting the upper body to a transfer chamber adjacent the lower body, a delivery conduit connecting the transfer chamber to a level above a surface of the upper body, a valve between the inlet conduit and the transfer chamber, and a gate between the transfer chamber and the lower body, wherein the inlet conduit is dimensioned to hold water so that operatively, once the gate is closed and the valve is opened, the fish in the transfer chamber are transported with the water in the transfer chamber through the delivery conduit to the level above the surface of the upper body only when the gate is closed and the valve is opened.

2. The system according to claim 1, wherein the delivery conduit holds less water than the inlet conduit.

3. The system according to claim 1, wherein the gate provides access for the fish to enter the transfer chamber from the lower body, and an attraction flow of water is provided through the gate.

4. The system according to claim 1, wherein the inlet conduit may have a column of water extending higher than the surface of the upper body.

5. The system according to claim 1, wherein the delivery conduit discharges to a different body of water than the upper body.

6. The system according to claim 1, in which only the valve is required to be controlled to facilitate the fish transfer, and no additional valve is required to be present between the transfer chamber and the discharge conduit.

7. The system according to claim 1, in which the valve and gate are automatically controllable.

8. The system according to claim 1, wherein once the gate is closed, transport of the water and the fish is initiated by opening the valve.

9. A method for transferring fish past a barrier between an upper body and a lower body of water, wherein structures are provided including an inlet conduit connecting the upper body to a transfer chamber adjacent the lower body, a delivery conduit connecting the transfer chamber to a level above a surface of the upper body, a valve between the inlet conduit and the transfer chamber, and a gate between the transfer chamber and the lower body, the method including at least the steps of:

a) closing the gate to seal the transfer chamber,
b) opening the valve to connect the inlet conduit to the transfer chamber, thereby transporting any fish in the transfer chamber with the water in the transfer chamber through the delivery conduit, and
c) discharging the fish from the delivery conduit only when the gate is closed and the valve is opened.

10. The method according to claim 9, wherein after discharging the fish, the valve is closed, the gate is opened, and the water drains from the delivery conduit into the lower body.

11. The method according to claim 9, wherein the gate provides access for the fish to be attracted into the transfer chamber, and an attraction flow of water is provided through the gate.

12. The method according to claim 9, wherein the gate and valve are automatically controlled to perform the method.

13. A method for modifying a barrier between an upper body and a lower body of water to provide a fish transfer system, including installing structures including an inlet conduit connecting the upper body to a transfer chamber adjacent the lower body, a delivery conduit connecting the transfer chamber to a level above a surface of the upper body, a valve between the inlet conduit and the transfer chamber, and a gate between the transfer chamber and the lower body to allow the fish to be attracted into the transfer chamber, wherein the inlet conduit is dimensioned to hold sufficient water so that, once the gate is closed and the valve is opened, fish in the transfer chamber are transported with the water in the transfer chamber through the delivery conduit to the level above the surface of the upper body, only when the gate is closed and the valve is opened.

14. The method according to claim 13, wherein the inlet and delivery conduits are formed as pipes and installed adjacent to the barrier or other structures.

15. The method according to claim 14, wherein the inlet and/or delivery conduits is installed with suitable grades, which are not vertical.

* * * * *